United States Patent [19]

Pollard

[11] 4,356,498

[45] Oct. 26, 1982

[54] TOWER ASSEMBLY

[76] Inventor: Bernard R. Pollard, 5603 Alan St., Aliquippa, Pa. 15001

[21] Appl. No.: 259,807

[22] Filed: May 4, 1981

[51] Int. Cl.[3] ..... H01Q 1/10

[52] U.S. Cl. ..... 343/890; 52/121

[58] Field of Search ..... 343/890, 891, 880, 883; 52/111, 115, 121

[56] References Cited

U.S. PATENT DOCUMENTS

| | | | |
|---|---|---|---|
| 2,983,342 | 5/1961 | Howard | 343/883 |
| 3,327,437 | 6/1967 | Rush | 343/883 |
| 3,959,795 | 5/1976 | Foster | 343/883 |

*Primary Examiner*—David K. Moore

[57] ABSTRACT

An improved tower for positioning an antenna comprises a tower having a flexibly moveable carriage which supports the antenna, automatic latching means, and remotely controlled means for raising and lowering the carriage and antenna along the periphery of the tower.

2 Claims, 5 Drawing Figures

TOWER ASSEMBLY

BACKGROUND OF THE INVENTION

Systems useful for raising and lowering antennas that are mounted on towers are known in the art. For example U.S. Pat. No. 3,959,795 is of such type. In addition, telescoping or fold-over towers are known. These towers are cumbersome in the sense that the antenna, in its lowermost position, is not servicable without use of a ladder or the like. A third type of antenna tower does not involve a hoisting system and thus requires more than one person to manually raise and lower the antenna.

U.S. Pat. No. 3,959,795 discloses an antenna hoisting system that employs a carriage that slides along the tower. This system employs a winch arrangement, located within the inside of the tower, to effect raising and lowering of the carriage and antenna. This application constitutes an improvement over the system of aforementioned U.S. Pat. No. 3,959,795 because of the combination of latching means, glide means for the carriage, and exterior location of the powered means for positioning the carriage and antenna. This latter advantage is also important in that such location facilitates lowering of the carriage and antenna to the bottom of the tower where repairs, tuning, inspection and like operations can be performed without need for a ladder.

SUMMARY OF THE INVENTION

The invention generally comprises a tower assembly that is useful for raising an antenna to a desired height and for lowering the antenna to a height proximate to ground level so that the antenna can be serviced, inspected, repaired, installed, tuned, or the like. Ham or C.B. antennas are common types of antennas suitable for use of the invention. The assembly system is such that one person can raise and lower the antenna.

The tower assembly contains a base for supporting the tower; an interconnected upright section connected to the base which has at least three upright members; a carriage to support the antenna. The carriage is raised and lowered to position the antenna. The carriage is constructed so as to be flexibly connected to and surround the upright member thereby facilitating sliding movement of the carriage along the upright members. An automatic latch mechanism for locking the carriage in position at the top of the tower is also included. A hoist arrangement causes the carriage to change position along the tower. The activation means for the hoist are located outside of the area defined by the interior of the upright members. Such means can comprise a motor powered or manual winching system.

DETAILED DESCRIPTION OF THE INVENTION

Figure 1:
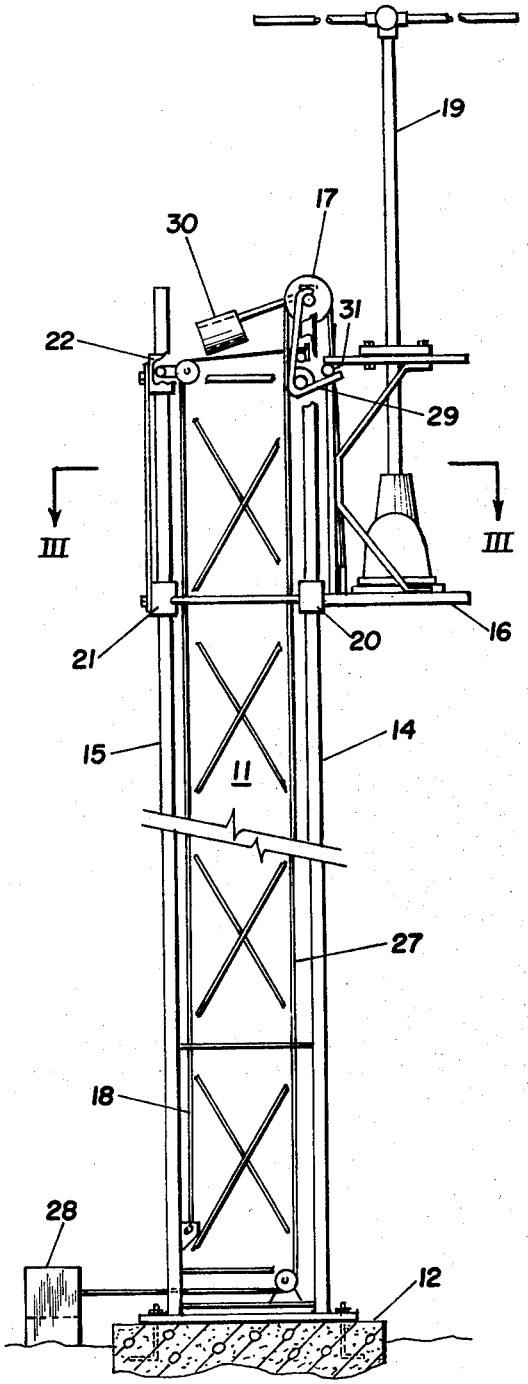
FIG. 1 is a front sectional view of the tower assembly which illustrates the antenna in its intended operative position and the carriage assembly in the latched position.

FIG. 1 is a front view sectional of tower assembly 11 which is secured to base 12. The assembly has at least three upright members, 13, 14, and 15 (not shown) respectively, along which carriage 16 is raised and lowered. Carriage 16 is shown in the locked position at the top of the assembly. Latching means 17 is used to secure the carriage in position. Latch release means 18 are used to unlock the carriage. Antenna 19 is held by carriage 16. As carriage 16 is raised latch engaging member 31 passes rocker arms 29 of latching means 17 which then, due to counterweight 30, automatically returns to the locked position shown in FIG. 1. Carriage 16 is raised and lowered by sliding along upright members 13, 14, 15 with use of glide members 20, 21, 22, 23, 24 and 25, the latter two members not shown in the drawing. Positioning means 27 consists of a cable connected to a pulley arrangement for raising and lowering carriage 16. Activation means 28 provide the necessary force and braking power to raise and lower the carriage through control of hoist means 27.

Figure 2:
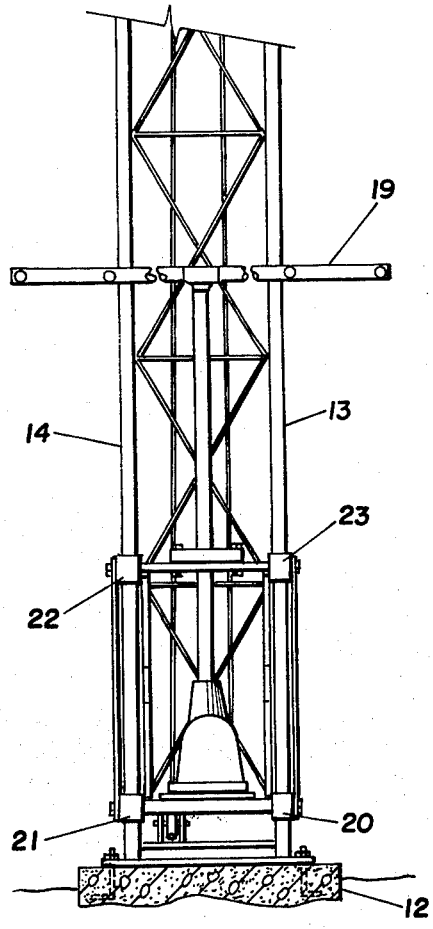
FIG. 2 is a partial front sectional view of the lower assembly with the antenna positioned in the downmost position.

FIG. 2 illustrates the carriage and antenna in the downmost position where suitable repair, inspection, installation and the like can be easily accomplished. It should be noted that the down position is substantially at the lowest portion of the tower.

Figure 3:
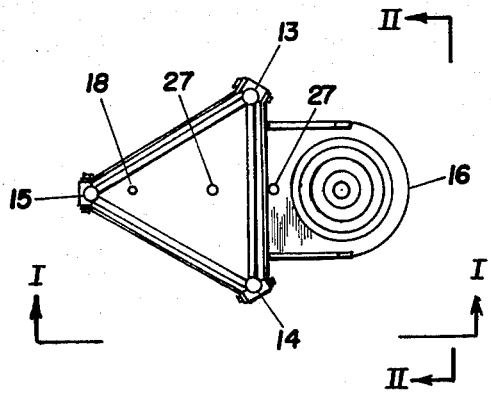
FIG. 3 is another sectional view of the tower assembly along line III—III of FIG. 1.

FIG. 3 is another view of the assembly taken along line III—III of FIG. 1. This view further illustrates the three upright members and the fact that the carriage surrounds the upright members and slides or moves along the surface of the upright members.

Figure 4:
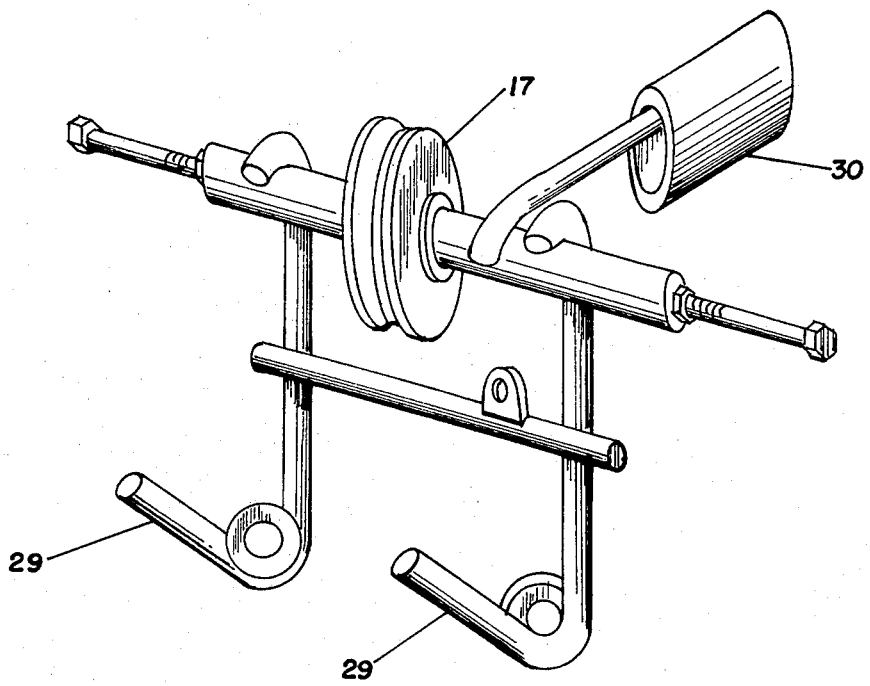
FIG. 4 illustrates the latch mechanism of the assembly.

FIG. 4 is an illustration of the automatic latch mechanism of the invention. FIG. 1 further describes the relationship of the latch and the balance of the antenna assembly. The latch is of the rocker hanger type that utilizes weight 30 to apply the latching force. Such force is generated by gravity. The latch automatically engages when the carriage reaches a predetermined point at the top of the tower. Unlatching in preparation for lowering the carriage is accomplished by raising the carriage a small distance so as to permit the rocker arm to disengage from the carriage and then pulling latch cord 18 so as to swing the latch free of the carriage. The carriage is then lowered to the desired position and the latch cord released so as to permit the latch to be prepared to automatically lock when the carriage is next raised. The latch mechanism is advantageous in that, when in the locked position, the latch rather than the hoist cable bears the weight of the carriage and antenna. This minimizes the amount of strain placed upon the hoisting system.

Figure 5:
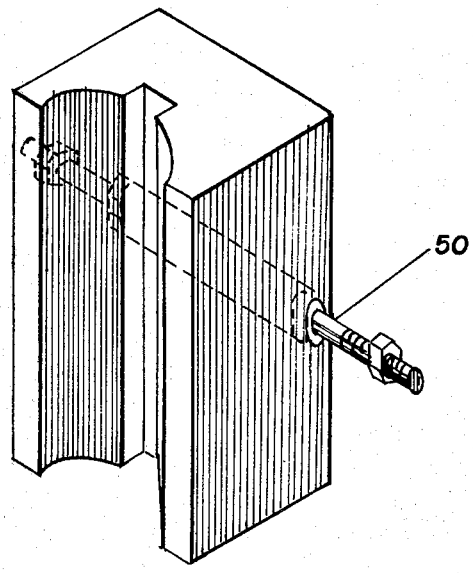
FIG. 5 depicts the glide member which slides along the upright tower members during positioning of the carriage.

FIG. 5 illustrates one of the six glide members of the invention. The glide member is advantageously comprised of or coated with polypropylene to reduce friction between the glide and upright member. Such glides are connected to the carriage by bolt 50 which is connected through the carriage. The glides are mounted in such a manner that a swiveling or pivoting type action is obtained thereby permitting adjustment to surface irregularities of the upright members. The interior portion of the glide is shaped so as to conform with the upright member shape.

I claim:

1. A tower for positioning an antenna comprising:

a. a base for supporting said tower;

b. said tower being connected to said base and having at least three upright members, a top portion, and a bottom portion;

c. carriage means for supporting an antenna and surrounding said upright members, said carriage means flexibly connected to said upright members by glide members that facilitate sliding movement along said upright members, said glide members comprising a spacer having a shaped interior surface adapted to generally conform at least a portion of said interior surface to the shape of said upright members and held in position by a single holding member whereby said glide member is free to rotate about said holding member and thereby enhance flexibility of movement of said glide member along said upright members;

d. latching means connected to said tower for securing said carriage means to the top portion of said tower, said latching means comprising a latch of the rocker arm type that automatically locks onto a portion of said carriage means thereby relieving said activation means from forces created from holding said carriage in position, and further comprising means for releasing said latching means from the locked position upon raising of said carriage means;

e. positioning means connected to said carriage means for raising and lowering said carriage along said tower; and f. activation means connected to said positioning means, said activation means activation means being located at a position outside of an area defined by said upright members.

2. The tower of claim 1, wherein:

said shaped glide member is composed of polypropylene.

* * * * *